US005263465A

United States Patent [19]

Anderson

[11] Patent Number: 5,263,465

[45] Date of Patent: Nov. 23, 1993

[54] ARCHERY BOW WITH SHORT ARROW LAUNCHING ASSEMBLY

[76] Inventor: Jeffrey R. Anderson, 162 Slocum Lake Rd., Wauconda, Ill. 60084

[21] Appl. No.: 967,758

[22] Filed: Oct. 28, 1992

[51] Int. Cl.[5] ..... F41B 5/22

[52] U.S. Cl. ..... 124/24.1; 124/44.5; 124/86

[58] Field of Search ..... 124/23.1, 24.1, 25.5, 124/25.6, 25.7, 44.5, 86, 88

[56] References Cited

U.S. PATENT DOCUMENTS

| | | | |
|---|---|---|---|
| 4,290,407 | 9/1981 | Damron | 124/44.5 |
| 4,446,844 | 5/1984 | Nishioka | 124/44.5 |
| 4,829,974 | 5/1989 | Anderson | 124/24.1 |
| 4,958,617 | 9/1990 | Anderson | 124/24.1 |
| 5,022,378 | 6/1991 | Rhodehouse et al. | 124/44.5 |
| 5,119,797 | 6/1992 | Anderson | 124/25 |
| 5,205,267 | 4/1993 | Burdick | 124/24.1 |

*Primary Examiner*—Randolph A. Reese
*Assistant Examiner*—John Ricci
*Attorney, Agent, or Firm*—Lockwood, Alex, Fitzgibbon & Cummings

[57] ABSTRACT

A bow and kit for mounting thereon which allows the bow to shoot short arrows (e.g., 6 inches long) which are several times shorter than arrows of conventional length (e.g., 22 inches) normally shot by a longbow. The kit includes a riser bracket to be mounted on the riser or handle of the bow, a pivot bracket pivotally mounted on the riser bracket and a launching track mounted on the pivot bracket. The pivot bracket allows the launching track to be stored in a folded position on the bow and quickly placed in a ready position for arrow launching with the pivot bracket interlocked with the riser bracket.

14 Claims, 3 Drawing Sheets

ARCHERY BOW WITH SHORT ARROW LAUNCHING ASSEMBLY

BACKGROUND AND DESCRIPTION OF THE INVENTION

This invention relates to new and useful improvements in archery bows (including longbows, compound bows and recurve bows) which enables them to shoot short arrows which are several times shorter than the arrows of conventional length customarily shot from bows. The invention also relates to kits which incorporate the invention and which may be readily installed on a conventional bow.

An important object of the invention is the provision of a kit which is relatively inexpensive to mass produce and which may be readily assembled and mounted on the riser of a conventional bow so as to enable the bow to be used to launch and shoot arrows which are several times shorter than conventional arrows. Arrows of conventional length can also be shot with greater accuracy from a bow equipped with the invention.

An important object of the invention is the provision of such a kit which upon being removed from the riser of a bow restores the bow to its original condition and allows it to shoot arrows of conventional length.

Still another important object of the invention is to provide bows which, as originally constructed, are equipped and designed to shoot short arrows so that the novel features of the kit provided by the present invention are presently incorporated and designed into the bows as originally manufactured.

Certain other objects of the invention will be apparent to those skilled in the art in view of the following detailed description of one embodiment of the invention taken in connection with the accompanying drawings wherein.

Figure 2:
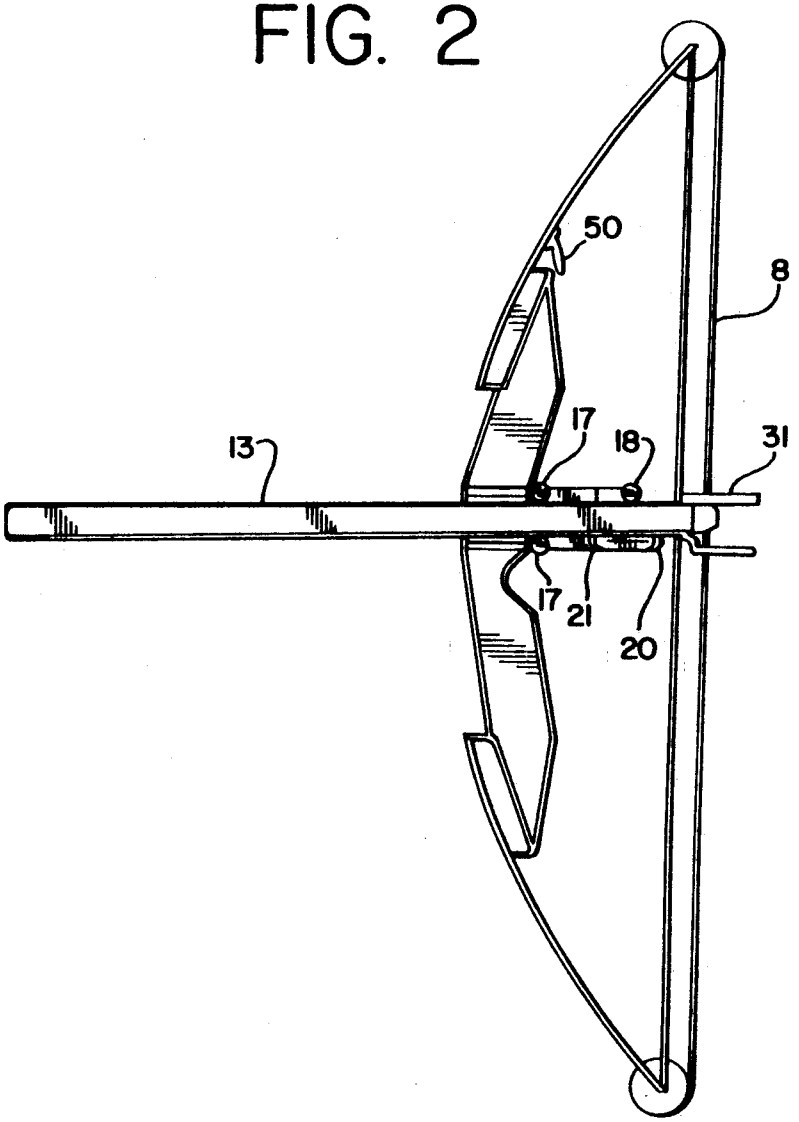
FIG. 2 is a side elevational view of the bow assembly shown in FIG. 1 with the short arrow launching track unit pivoted into its ready position wherein the bow may be used to launch a short arrow.
Figure 1:
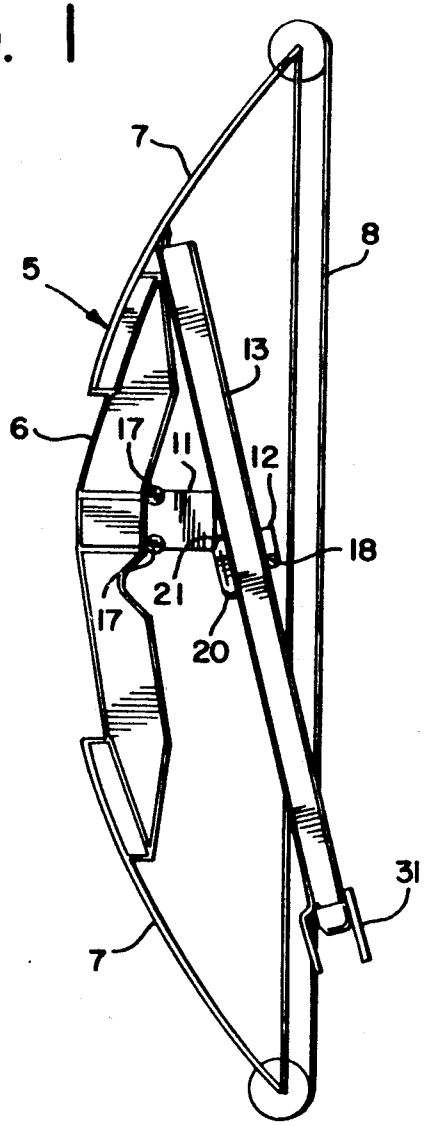
FIG. 1 is a side elevational view of a bow on which a kit embodying the invention has been installed with the short arrow launching track unit of the kit shown in its stored condition on the bow.
Figure 3:
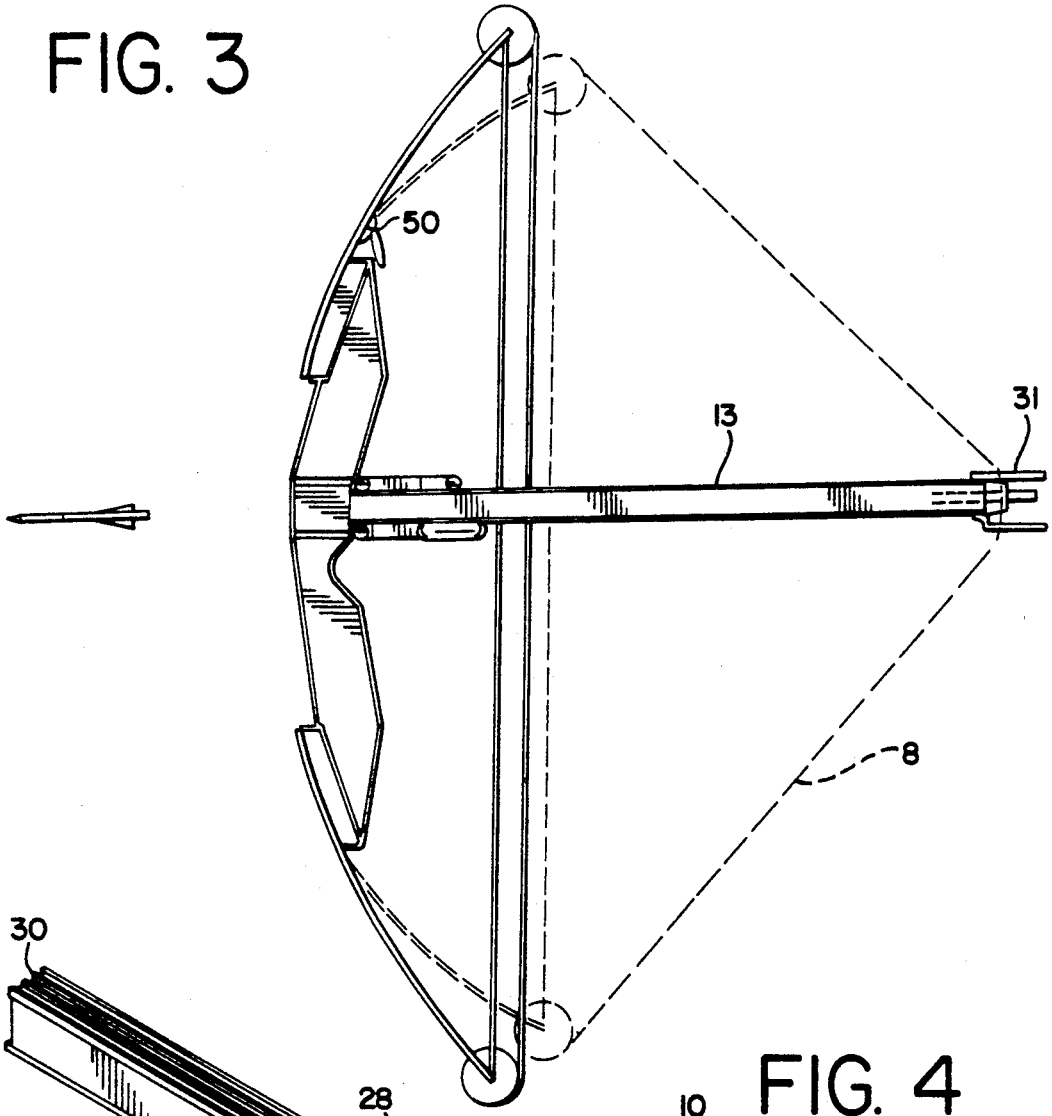
FIG. 3 is a side elevational view showing the bow assembly of FIG. 2 with the short arrow launching track in its drawn position on the bow with the limbs of the bow shown in broken lines in the drawn position of the bow and with the bow string shown in arrow launching position in broken line.

In FIGS. 1-3, a conventional compound bow is indicated generally at 5. It will be understood that the bow 5 is representative of commercially available compound bows, longbows and recurve bows. The bow 5 has a conventional construction and comprises a riser or handle 6 on which upper and lower limbs 7—7 are mounted. A bow string 8 is secured to the outer extremities of the limb 7 in known manner.

Figure 4:
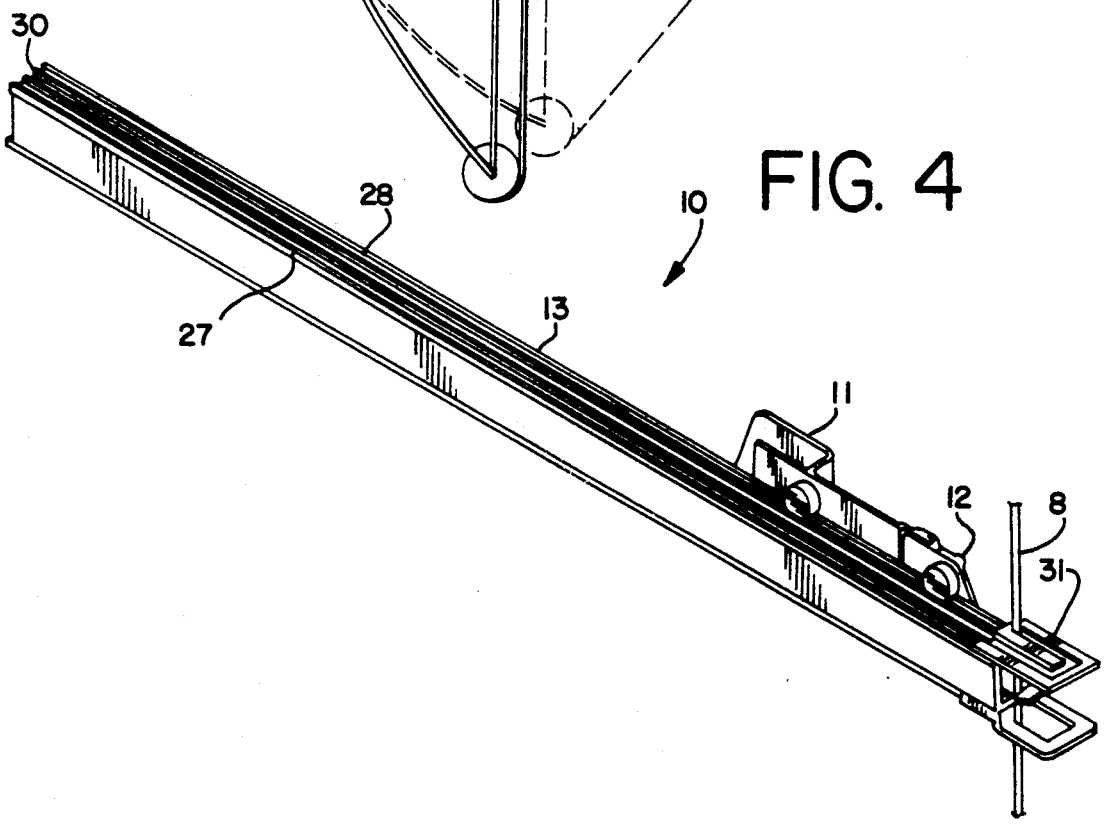
FIG. 4 is a top perspective view of the kit installed on the bow as shown in FIG. 1-3.
Figure 5:
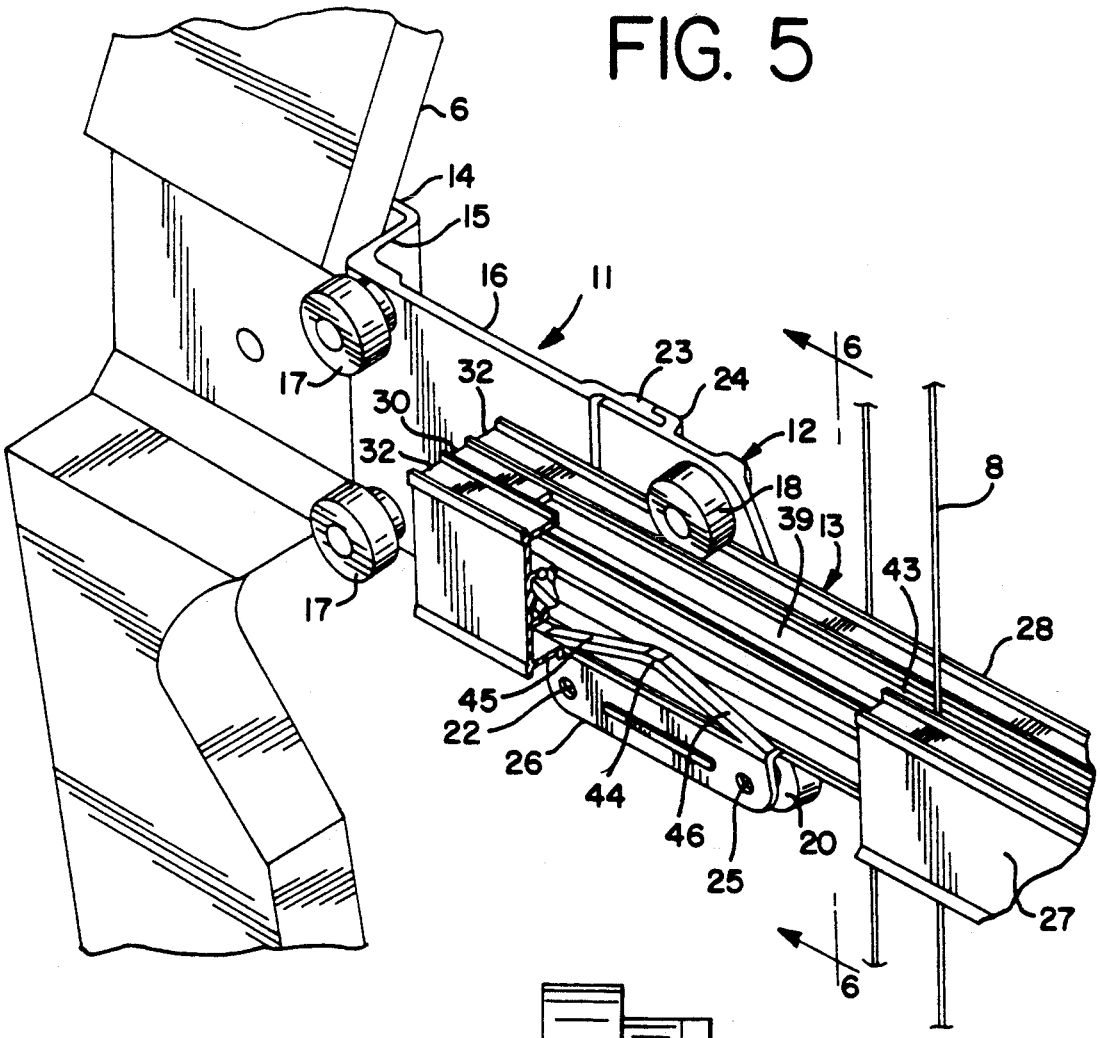
FIG. 5 is a fragmentary perspective view on enlarged scale showing the mounting of the short arrow launching kit on the riser of a bow.

A kit embodying the present invention is indicated generally at 10 in FIG. 4, assembled and ready to be mounted on the bow 5. Referring to FIGS. 4 and 5, the kit 10 comprises a riser bracket 11 mounted on the riser 6 of the bow 5, a pivot bracket 12 pivotally attached to the riser bracket 11 and a short arrow launching track assembly 13 reciprocally mounted on the pivot bracket 12 and also on the riser bracket 11 when the two brackets are interlocked as shown in FIGS. 4 and 5.

The riser bracket 11 is generally in the form of a vertical flat plate having a riser attaching portion 14 (FIG. 5) joined by a right angle bend 15 to a pivot bracket mounting portion 16. The riser bracket 11 has a pair of vertically spaced track engaging and guiding rollers 17—17 mounted thereon.

The pivot bracket 12 is generally in the form of a plate and carries an upper roller 18 and a pair of longitudinally spaced bottom rollers 20 and 21. All of the rollers 17, 18, 20 and 21 have reduced diameter bosses by which they are spaced from their respective plates 11 and 12. The pin 22 on which forward bottom roller 21 is pivotally mounted also serves as a pivot pin to pivotally interconnect the pivot bracket 12 to the riser bracket 11.

The riser bracket 11 on its rear end has an off-set locking formation 23 which mates and interlocks a locking formation 24 on the pivot bracket 12 as shown in FIGS. 4 and 5.

The pivot pin 22 on which the roller 21 is mounted and the pin 25 on which the rear lower roller 20 is mounted, extend outwardly beyond these respective rollers so as to project through and support a track stop 26, the purpose and function of which will be referred to below.

The short arrow launching track assembly 13 comprises a pair of left and right-hand elongated track members 27 and 28 which may be integrally interconnected at the muzzle end of the assembly 13 by an interconnection 30. At their breach end, the side members 27 and 28 are interconnected by an attachment 31 (FIG. 4) which also serves as a keeper or retainer for holding the bow string 8 out of the way while an arrow is being loaded into the track assembly 13 and prevents the sharp cutting edges on the arrow head from cutting the bow string. The attachment 31 also provides a space or opening to grip the nock of an arrow and release the bow string at the proper time.

Figure 6:
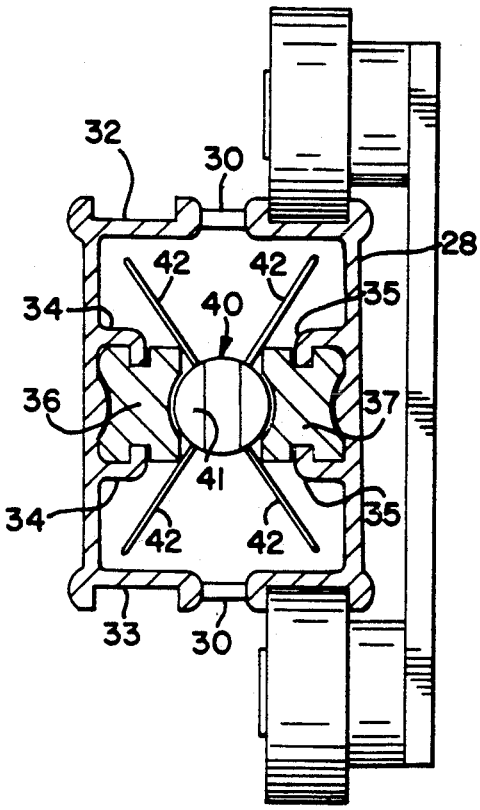
FIG. 6 is a cross-sectional view taken on line 6—6 of FIG. 5 certain parts being shown in elevation.

The left and right-hand track members 27 and 28 may be formed by cutting a slot in a single extrusion of aluminum or other suitable rigid material or by interconnecting at 30 two separate extrusions. As seen in FIG. 6, the track members 27 and 28 have symmetrical cross-sections. Each track member 27 and 28 has upper and lower exterior grooves 32 and 33 for receiving therein the support and guidance of rollers 17, 18, 20 and 21. On their interiors, the track members 27 and 28 have longitudinally extending hook-like formations 34—34 and 35—35 respectively for receiving therein elongated arrow guide strips 36 and 37, respectively. The guide strips are formed of a low friction material such as high density or ultra-high molecular weight polyethylene or other suitable material having similar properties. Each of the inserts 36 and 37 has a symmetrical cross-section whereby each may be removed and rotated 180° thereby exposing a second arrow shaft engaging guiding and wear surface.

In FIG. 6, an arrow is indicated generally at 40 which may correspond to the short arrow shown and described in connection with FIGS. 5-7 of my U.S. Pat.

No. 5,119,797 dated Jun. 9, 1992, the disclosure of which is incorporated by reference herein. The shaft of the arrow is indicated at 41. Four blades or fins 42—42 serve as the fletching for the arrow 40. The open spaces above and below the shaft 41 of the arrow 40 and the elongated inserts 36 and 37 provide for the unimpeded travel of the blades 42 through the length of the track assembly 13 as the arrow 40 is released and launched.

The integral connection 30 at the muzzle end of the track assembly 13 and the fitting 31 at the breach end thereof serve to space the track members 27 and 28 apart a uniform distance so as to provide an uninterrupted vertical slot 39 (FIG. 5) extending through most of the length of the track assembly 13 in which the bow string 8 is free to travel between its undrawn and drawn conditions.

The track stop 26 (FIG. 5) has an upstanding projection 44 with forwardly and rearwardly, downwardly inclined edges 45 and 46, respectively. The stop 26 prevents the track assembly from falling out of the pivot bracket 12 when the assembly is taken out of its stored condition. The ramped edges 45 and 46 also serve to recenter an arrow in the event the archer inadvertently separates the track members during the loading process.

To assemble the kit 10, the pivot bracket 12 will be first pivotally attached to the riser bracket 11 and then the latter will be attached to the riser 6 of the bow 5. Prior to attachment of the fitting 31 at the breach end, the track assembly 13 is inserted from its breach end between the rollers 18, 20 and 21 on the pivot bracket 12. The fitting 31 is then attached at the breach end. The kit is now completely assembled and installed on the longbow 5.

When not in use, the bow 5 may be readily stored in a collapsed or stored condition as shown in FIG. 1. In this condition, the muzzle end of the track assembly 13 is frictionally engaged with a storage clip 50 mounted on the upper spline or limb 7. When it is desired to use the bow 5, the track assembly 13 is removed from the clip 50 and retracted sufficiently so as to allow the pivot plate to be rotated upwardly so as to bring it into interlocking engagement with the riser plate as shown in FIGS. 4 and 5. The track assembly 13 can now be moved forwardly to the relative position shown in FIG. 2.

In order to shoot or launch an arrow, the bow string 8 is drawn and shifted into the retaining groove in the fitting 31 as shown in FIG. 4. A short arrow is now inserted into the breach end with the archer maintaining a grasp on the nock end of the arrow. When the archer is ready to shoot, the bow string 8 is moved out of the retaining groove and into the nock of the arrow. Upon the simultaneous release of the nock and bow string, the action of the bow takes over and launches the arrow out of the muzzle end of the track assembly 13.

It will be understood that certain changes may be made in the foregoing embodiment of the invention without departing from the spirit and scope of the appended claims. Certain of these changes have been mentioned. One not previously mentioned is the replacement of the fitting 31 at the breach end of the launching track 13 with a known trigger type string release such as a "LOBO" model string release manufactured by Tru-Fire Corporation, N 7355 State Street, North Fond Du Lac, Wis. 54935. The use of such a string release improves the accuracy of many archers in that it tends to eliminate jerking when the bow string and arrow are released. However, when a string release is used an arrow has to be loaded tail end first in the muzzle end of the track assembly 13.

What is claimed is:

1. A kit for assembly and attachment to a longbow that will allow the bow to shoot arrows which are several times shorter than arrows of conventional length normally shot from the longbow, comprising, a riser bracket to be rigidly mounted on the bow riser, a pivot bracket pivotally mountable on said riser bracket, and short arrow launching track means reciprocally mountable on said pivot bracket and having a muzzle end and a breach end, said short arrow launching track means providing low friction guide surfaces engageable by the shaft of an arrow as it is being launched and also open spaces allowing unobstructed passage of fletching on an arrow as it is being launched and comprising, an elongated outer support, elongated interior inserts formed of low friction material which provide said low friction guide surfaces for engaging arrow shafts on opposite sides, said inserts being mounted within said elongated outer support, and wherein said elongated outer support comprises left and right track members joined together adjacent at least one of said muzzle and breach ends leaving an elongated vertical bow string receiving slot extending between said muzzle and breach ends, one of said interior elongated inserts being mounted on one of said left and right track members and the other of said elongated inserts being mounted on the other of said track members and one of said track members and said pivot bracket having interengaging track support means for reciprocally mounting said short arrow launching track means on said pivot bracket.

2. The kit called for in claim 1 wherein said riser bracket and said pivot bracket have mating formations whereby said brackets may be interlocked when said short arrow launching track means is in an arrow launching position and wherein said riser bracket has interengaging support means for reciprocally mounting said short arrow launching track means in cooperation with said interengaging support means on said one of said track members and said pivot bracket.

3. The kit called for in claim 2 wherein said mating formations are disengageable and when disengaged said short arrow launching track means is reciprocal only on said pivot bracket.

4. The kit called for in claim 3 wherein said interengaging track support means for reciprocally mounting said short arrow launching track means comprises a pair of vertically spaced guide and support rollers on said riser bracket and at least one pair of vertically spaced guide and support rollers on said pivot bracket, and said one track member having interengaging support means having longitudinal grooves in its upper and lower surfaces which interengage with said vertically spaced rollers.

5. The kit called for in claim 4 wherein said pivot bracket has an upper support and guide roller and a pair of longitudinally spaced lower support and guide rollers, and said pivot bracket pivots on an axis which coincides with the axis of the one of said lower support and guide rollers adjacent said riser bracket.

6. The kit called for in claim 1 wherein said left and right track members are symmetrical in cross-section and said interior elongated inserts are removable and symmetrical in cross-section whereby each of said inserts has two arrow-engaging guide and wear surfaces.

7. The kit called for in claim 6 wherein each of said left and right track members has interior formations providing a pair of spaced opposing vertical flanges and each of said inserts has a pair of side grooves in which said flanges fit.

8. In a bow for shooting arrows which are several times shorter than arrows of conventional length the improvement comprising, a riser bracket rigidly mounted on the riser of the bow, a pivot bracket pivotally mounted on said riser bracket; and short arrow-launching track means reciprocally mounted on said pivot bracket and having a muzzle end and a breach end, said short arrow launching track means providing low friction guide surfaces engageable by the shaft of an arrow as it is being launched and also open spaces allowing unobstructed passage of fletching on an arrow as it is being launched and comprising, an elongated outer support, elongated interior inserts formed of low friction material which provide said low friction guide surfaces for engaging arrow shafts on opposite sides, said inserts being mounted within said elongated outer support, and wherein said elongated outer support comprises left and right track members joined together adjacent at least one of said muzzle and breach ends with an elongated vertical bow string receiving slot extending between said muzzle and breach ends, one of said interior elongated inserts being mounted on one of said left and right track members and the other of said elongated inserts being mounted on the other of said track members and one of said track members and said pivot bracket having interengaging track support means for reciprocally mounting said short arrow launching track means on said pivot bracket.

9. The improvement called for in claim 8 wherein said riser bracket and said pivot bracket have mating formations whereby said brackets may be interlocked when said short arrow launching track means is in an arrow launching position and wherein said riser bracket has interengaging support means for reciprocally mounting said short arrow launching track means in cooperation with said interengaging support means on said one of said track members and said pivot bracket.

10. The improvement called for in claim 9 wherein said mating formations are disengageable and when disengaged said short arrow launching track means is reciprocal only on said pivot bracket.

11. The improvement called for in claim 10 wherein said interengaging track support means for reciprocally mounting said short arrow launching track means comprises a pair of vertically spaced guide and support rollers on said riser bracket and at least one pair of vertically spaced guide and support rollers on said pivot bracket, and said one track member having interengaging support means having longitudinal grooves in its upper and lower surfaces which interengage with said vertically spaced rollers.

12. The improvement called for in claim 11 wherein said pivot bracket has an upper support and guide roller and a pair of longitudinally spaced lower support and guide rollers, and said pivot bracket pivots on an axis which coincides with the axis of the one of said lower support and guide rollers adjacent said riser bracket.

13. The improvement called for in claim 8 wherein said left and right track members are symmetrical in cross-section and said interior elongated inserts are removable and symmetrical in cross-section whereby each of said inserts has two arrow-engaging guide and wear surfaces.

14. The improvement called for in claim 13 wherein each of said left and right track members has interior formations providing a pair of spaced opposing vertical flanges and each of said inserts has a pair of side grooves in which said flanges fit.

* * * * *